United States Patent [19]

Scholl

[11] 4,166,649

[45] Sep. 4, 1979

[54] DEVICE FOR REMOVING WORKPIECES FROM A CONTAINER

[75] Inventor: Herbert Scholl, Buchenrain 149, D 7320 Göppingen-Ursenwang, Fed. Rep. of Germany

[73] Assignee: Herbert Scholl, Göppingen-Ursenwang, Fed. Rep. of Germany

[21] Appl. No.: 849,644

[22] Filed: Nov. 8, 1977

[30] Foreign Application Priority Data

Nov. 16, 1976 [DE] Fed. Rep. of Germany ..... 2652188

[51] Int. Cl.[2] ..... B66C 1/04

[52] U.S. Cl. ..... 294/65.5

[58] Field of Search ..... 294/65.5; 214/1 BT, 214/1 QD, 1 BS, 1 BU, 8.5 D, 658

[56] References Cited

U.S. PATENT DOCUMENTS

| | | | |
|---|---|---|---|
| 3,567,045 | 3/1971 | Allbright et al. | 294/65.5 |
| 3,599,804 | 8/1971 | Chorney | 294/65.5 |

*Primary Examiner*—James B. Marbert

[57] ABSTRACT

A device for removing a plurality of ferromagnetic, stacked or dumped, workpieces from a container incorporates a switchable magnetic holder which can be moved up and down by means of a hoisting apparatus and, moreover, can be shifted in an approximately horizontal plane and positioned over the said container and a conveyor respectively. The magnetic holder takes the form of a magnet carrier plate mounting a plurality of holding magnets of which at least one is an a.c. magnet. Means are provided for gradually reducing the excitation of the holding magnet while the material handled is being dropped. What is achieved by these means for gradually reducing the excitation of the holding magnet while the workpieces handled are being dropped or deposited is that these are left in a non-magnetic state after their separation from the magnet carrier plate, thereby avoiding problems in subsequent plant operation or later processing thanks to the removal of residual magnetism without the need for any additional demagnetizing means.

9 Claims, 3 Drawing Figures

DEVICE FOR REMOVING WORKPIECES FROM A CONTAINER

Figure 1:
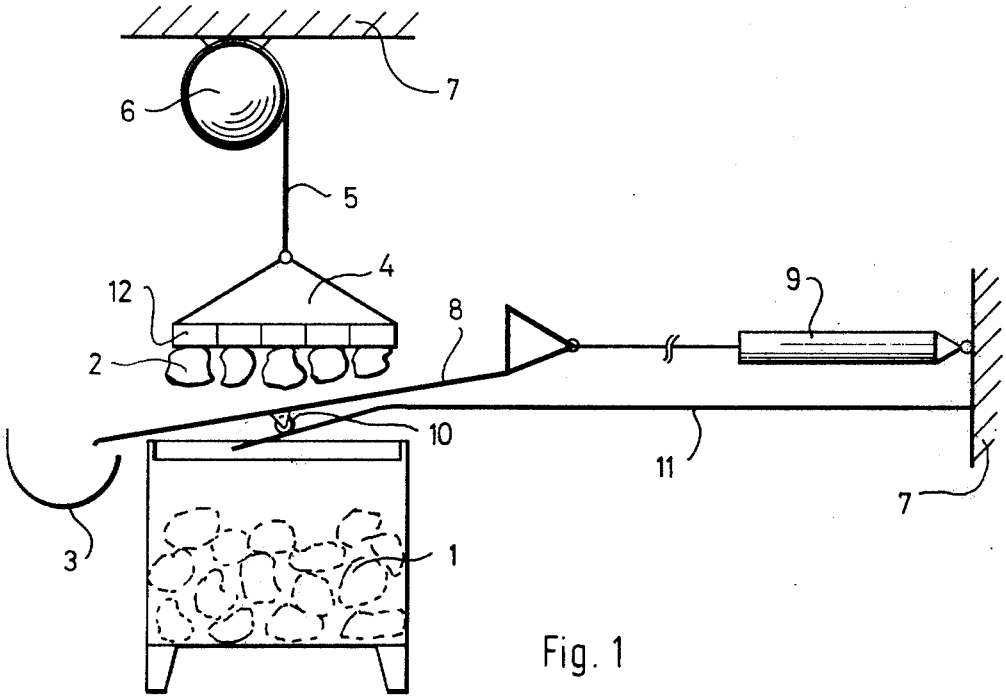

The present invention relates to a device for removing a plurality of ferromagnetic, stacked or dumped, workpieces from a container, comprising a switchable magnetic holder capable of being moved up and down by means of a hoisting apparatus and of being lowered into the said container and positioned over a conveyor, said magnetic holder taking the form of a magnet carrier plate mounting a plurality of holding magnets.

In a known device of this type (German "Auslegeschrift"* 21 16 643), the magnet carrier plate is equipped with a number of holding magnets arranged so as to be loosely movable in the magnet carrier plate. The poles of the holding magnets are designed to suit the size and shape of the workpieces. The hoisting apparatus lowers the magnet carrier plate into the container to be emptied, whereupon the excitation of the holding magnets is turned on and the magnet carrier plate together with the workpieces clinging to it is lifted. Next, a conveyor is positioned under the magnet carrier plate and the workpieces are transferred to the conveyor by turning off the excitation of the holding magnets. As usual, the holding magnets are designed as constant field magnets, either as electromagnets or as switchable permanent magnets or as a combination of both. After being deposited on the conveyor, the ferromagnetic workpieces are still magnetized, depending on the degree of excitation required for handling and on the residual magnetism of the workpiece material. In many cases, this permanent magnetization poses no problems or it is eliminated in the course of subsequent operations, e.g. through a heating process such as brazing, malleablizing or the like. However, there are also cases where either the workpieces are not brought or cannot be brought to a sufficiently high temperature or where the residual magnetism poses problems for a processing operation following upon the handling operation. In such cases, either the containers cannot be emptied magnetically or emptying the container must be followed by a demagnetizing treatment, such as passing the workpieces through a demagnetizing a.c. field. The latter solution calls for added expenditure in terms of investment and space, while the former means giving up the advantages of magnetic unloading and replacing this method by some other procedure, such as mechanical dumping with hydraulic power which, in the case of stacked, orderly arranged parts, results in the loss of this order, and, in the case of dumped parts or workpieces, leads to irregular unloading because the workpieces frequently tend to become entangled and then drop out by jerks when the container is tipped. Moreover, mechanical dumping of the container involves an increased risk of damaging delicate parts.

*Auslegeschrift = publication of the examined application

It is the object of the present invention to provide a magnetically operating removing device which leaves the workpieces at least nearly non-magnetic after removal from the container and separation from the removing device.

According to the invention, this object is accomplished by designing a device of the type mentioned herein first above in such a manner that at least one of the holding magnets of the magnet carrier plate is an a.c. magnet and that means are provided for gradually reducing the excitation of the holding magnet while the material handled is being dropped.

It is a special advantage of the removing device in accordance with this invention that the use of a.c. electromagnets as holding magnets enables the parts to be damagnetized while they are being dropped without the need for additional demagnetizing means. All drawbacks of the prior art described herein above are thus overcome automatically, and such magnetic removing devices can be universally employed for handling ferromagnetic workpieces. A further advantage consists in that the rectifiers previously required for the supply of the magnets are either eliminated completely or that, where individual magnets or partial windings of the magnets are still d.c.-supplied, the ratings of such rectifiers can be substantially reduced. In connection with the use of a.c. magnets as holding magnets for handling ferromagnetic workpieces, it has been found that the heat-up accompanying magnetic reversal is generally so slight that it poses no problems, a fact which, among other things, is mainly due to the relatively short handling cycles. On the other hand, the excitation required and, thus, the heat generated in the workpieces is proportional to the weight of the workpiece by a first approximation so that the heating process is largely independent of the mass of the workpiece. This means that workpieces having a smaller mass will not be heated substantially faster or more intensely than workpieces having a greater mass. Consequently, the device of this invention is suitable for workpieces of virtually any size and shape.

Use of a device in accordance with this invention is particularly advantageous where the holding magnet or magnets is, or are, designed for three-phase a.c. supply. On the one hand, a three-phase a.c. supply results in a symmetrical loading of the supply system while, on the other hand, the phase difference of the magnetic fluxes in the individual poles assures a reliable force development which fluctuates only slightly. The number of poles of the holding magnets is either three or an integral multiple of three. Each magnet, whether a.c. or three-phase a.c., may be provided with an additional winding for special purposes, such as a d.c. supply or measuring and control functions.

The means provided for reducing the excitation of the holding magnets may take a great variety of different forms. In any case, however, it is essential that an alternating magnetic field with an amplitude decreasing as a function of time at the locus of the workpiece to be demagnetized exists or can be produced. According to a preferred embodiment of the invention, a regulating transformer which supplies at least one winding of the holding magnet and whose ratio can be varied while the material handled is being dropped is provided for this purpose. The regulating transformer employed to supply the magnet may, for instance, be stepped down so that the excitation decreases and the workpieces drop down. Owing to the reduced maximum field strength, magnetization is already reduced when the workpieces drop. If, in addition, the workpieces can move away from the holding magnets a short distance only, because the gap between the conveyor and the magnet carrier plate is kept narrow, the workpieces will still be within the field of the holding magnet and will be demagnetized completely when the regulating transformer supplying the magnet is further stepped down. The conveyor with the workpieces and the magnet carrier plate are then separated from each other, leaving the workpieces on the conveyor in a demagnetized condition. By discharging them from the conveyor, which may, for instance, take the form of a tiltable rocker, the workpieces are fed to the next processing station.

According to another embodiment of this invention, a phase-angle control device whose conducting period can be reduced when the material handled is being dropped is provided between the a.c. supply system and at least one of the windings of the holding magnet as means for reducing the excitation of the holding magnet. By reducing the conducting period, in a manner known per se, the effective magnetic field strength is reduced in a manner comparable to stepping down a regulating transformer. The effect is similar to the action described above with reference to the embodiment incorporating the regulating transformer. The advantage of using such phase-angle control devices consists in that these are devoid of mechanically moved parts and therefore capable of changing their state and, thus, the magnetic field strength very much faster.

To reduce the magnetic field strength at the locus of the workpiece, the present invention offers still another possibility. For this purpose, a capacitor is connected in parallel with at least one winding of the holding magnet. This capacitor may either be connected to said winding permanently or be connectable to said winding at the time when the supply current is switched off. If the current is then switched off, preferably at its peak, the resonant circuit consisting of coil and capacitor will perform heavily damped oscillations, i.e. oscillations of decreasing amplitude, thereby producing an alternating magnetic field which also decreases in amplitude at the locus of the workpiece and effects a demagnetization. The resonant circuit consisting of coil and capacitor need not be tuned to the frequency of the supply system, but may have a separate, higher frequency, resulting in a correspondingly faster decay of the magnetic field which, however, is still effective for demagnetizing purposes. The simplest solution from a technical point of view is an arrangement wherein the capacitor is permanently connected to the winding. Connecting the capacitor to the winding and switching off the supply current may, however, also be performed simultaneously or in synchronism.

According to the embodiments of the invention described herein above, the excitation of the holding magnet is reduced gradually in order to reduce the strength of the alternating magnetic field at the locus of the workpiece. Alternatively, it is, however, also possible to move the workpiece away from the holding magnet while the excitation of the holding magnet remains constant, decreases or even increases so that the strength of the magnetic field acting on the workpiece automatically decreases as a function of time. According to a preferred embodiment of the invention, this is achieved by providing a switch for briefly turning off at least one of the windings of the holding magnet for a predetermined number of cycles of the current supply. By briefly switching off the power supply for two, three or four cycles of a customary 50 Hz supply system, for example, the workpiece is separated from the holding magnet and drops down. If, on completion of the predetermined number of cycles, the magnet is turned on again, the workpiece will have moved away from the holding magnet about 1, 2 or 3 cm, for example, in free descent. When excitation then starts again, the force still exerted on the workpiece will no longer be sufficient to retard the workpiece and move it back again to the holding magnet. Nevertheless, the field of the holding magnet still acts on the workpiece during the following cycles, although with decreasing strength of the alternating field at the locus of the workpiece owing to the increasing distance. The desired demagnetization is also achieved in this manner. In many cases, it will be enough to turn off the magnet for one or two cycles only and then turn it on again with the same or even reduced excitation in order to achieve the desired effect. Since the demagnetizing behavior depends on the material and the shape of the workpiece, the most appropriate approach will generally have to be determined empirically. An expedient arrangement may be one wherein, according to a preferred embodiment of the invention, means are employed which permit a controlled increase of the excitation of the holding magnet after the switch has been turned on again. Since the movement of the falling workpiece is known or can be determined, it is thus possible to influence the change in the strength of the alternating magnetic field as a function of time in the desired manner. Once the workpiece has been released by the holding magnet, the geometric distribution of the magnetic field in the space underneath the poles depends on the design and construction of the magnet and can be influenced in a manner known per se. By considering the indicated parameters, it is possible to control virtually any application occurring in normal operation. Since a plurality of methods may be employed as described herein above, it is also possible to provide an optimum device for each application, adapted to suit the specific requirements of the application in question.

In order to make the device of this invention independent of any influence exerted by the user, preferred embodiments of this invention enable the control and switching operations to be initiated as a function of the cycle of movements of the removing device, especially by means of limit switches of any type.

Irrespective of whether a.c. magnets or three-phase a.c. magnets are employed as holding magnets, it may be an advantage if, according to preferred embodiments of this invention, the holding magnet has subdivided holes and one of the sub-poles is provided with a short-circuited winding. The current induced in the short-circuited winding is out-of phase, i.e. shifted, with respect to the supply current and, in turn, produces a magnetic field which is out-of-phase, or shifted, with respect to the magnetic field of the supply current, whereby the fluctuations of the resultant overall magnetic field as a function of time are reduced in magnitude. What is achieved thereby is a steadier attraction of the material handled, i.e. the workpieces clinging to the magnet.

Figure 2:
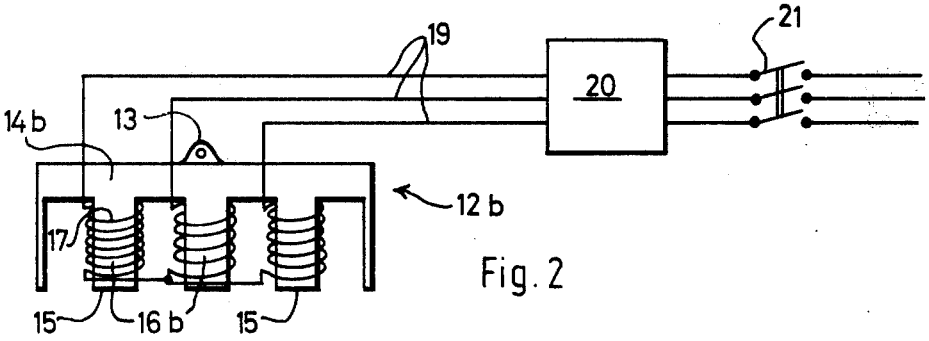
Figure 3:
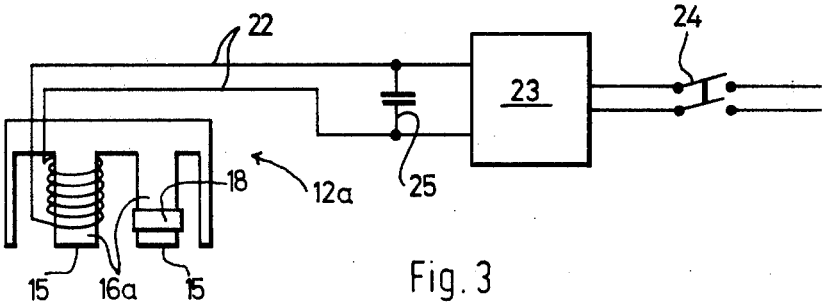

Further details and embodiments of the present invention will become apparent from the following description of embodiments of this invention shown by way of example and represented in a drastically schematized and simplified form in the accompanying drawing where FIG. 1 shows the mechanic of a removing device in accordance with this invention, FIG. 2 shows a three-phase a.c. magnet preceded by means for reducing the excitation, and FIG. 3 shows an a.c. magnet with sub-divided poles, a capacitor connected in parallel with the winding and means for controlling the excitation, preceding the magnet.

In a container 1, workpieces 2 are delivered, in a dumped or stacked condition, which are to be conveyed individually to a processing station (not shown) via a chute 3. For this purpose, a magnet carrier plate 4 is pivotally suspended from a tension member 5 of a hoisting apparatus 6 mounted on a frame or supporting structure 7 (not shown in detail), to which are also secured further components of the device, which is a portable unit, although this is not apparent from the schematized representation in FIG. 1.

A rocker 8 can be moved under the magnet carrier plate 4 by means of a ram 9. The ram 9 is pivoted to the supporting structure 7 at one end and the rocker 8 at the other end. On each side, the rocker 8 is provided with a roller 10, each roller running on one of two rails 11 disposed on both sides. The rail 11 is bent off in a downward direction in order to enable the rocker 8 to be swiveled about the pivot point of the ram 9 so that the workpieces can successively slide into the chute 3 after they have been released by the magnet carrier plate 4 and dropped onto the rocker 8. The rocker 8 can additionally be provided with a vibration generating device or a pulsating pressure can be applied to the ram 9 so that the rocker 8 performs shaking movements which cause the workpieces 2 to slide into the chute 3 at a uniform rate.

The magnet carrier plate 4 comprises a number of electromagnets 12 which are movably held in the magnet carrier plate 4, e.g. swivably suspended in the magnet carrier plate 4 by means of a lug 13. The electromagnets 12 are designed as a.c. magnets 12*a* or three-phase a.c. magnets 12*b*. They consist of conventional laminated or ferrite cores 14*a* or 14*b* respectively taking, for example, the form of cup cores with poles 15 at their open ends projecting downward from the magnet carrier plate 4, said poles being the faces of legs 16*a* or 16*b* respectively. The legs 16*a* or 16*b* are provided with windings 17. If any of the legs 16*a* is not provided with a winding 17, it can be provided with a short-circuited winding 18, consisting of a ring made of a material with good conducting properties, especially copper, placed around the leg. The windings 17 of the three-phase a.c. magnet 12*b* are connected to each other with one end each, and the three free ends are connected to an apparatus 20 via a three-wire line 19, said apparatus 20 being, in turn, connectable to a three-phase a.c. supply system (not shown) via a main switch 21. The apparatus 20, to which are connected one, several or all electromagnets or holding magnets 12*b* or 12*a*, may be a regulating transformer, but it may also be a known phase-angle control device or an electronic switch. If, as shown in FIG. 3, a.c. magnets 12*a* are used instead of three-phase a.c. magnets 12*b*, then these a.c. magnets 12*a* are connected to an apparatus 23 via a multiwire line 22. Said apparatus 23 may be of the same design as the apparatus 20 and is connected to an a.c. supply system (not shown) via a main switch 24. Irrespective of whether the holding magnets 12 are designed as a.c. magnets or as three-phase a.c. magnets, a capacitor 25 may be connected in parallel with one, several or all of the windings 17. The capacitor 25 may be rated so as to form a resonant circuit tuned to the frequency of the supply system with the winding 17 when a workpiece 2 is in contact with the poles 15. Alternatively, the arrangement may be such that the capacitor 25 and the winding 17 have a resonant frequency deviating from the frequency of the supply system when the workpiece drops or has dropped down.

The apparatus 20 or 23 may also include means for controlling the excitation of the magnets 12 as a function of time and/or as a function of the operating condition.

After a container 1 has been moved into the position shown in FIG. 1, the magnet carrier plate 4 is lowered by the hoisting apparatus 6, with the ram 9 retracted. At this stage, the electromagnets 12 in the magnet carrier plate 4 are preferably de-excited or excited very weakly only. When the magnet carrier plate 4 has reached its lower position, where it either starts to contact the workpieces 2 in the container 1 or is located at a very short distance from these workpieces, the excitation of the electromagnets 12 in the magnet carrier plate 4 is increased by appropriate driving action applied to the apparatus 20 or 23 whereby the workpieces 2 are attracted and held. Then the hoising apparatus 6 is switched on and lifts the magnet carrier plate 4 with the workpieces 2 clinging to it. Just after the hoisting apparatus 6 has been switched on, the excitation may be briefly reduced by the apparatus 20 or 23 in order to cause any workpieces 2 which are not held securely to drop off. Following this, the excitation is increased in order to ensure that the workpieces 2 will be held safely even if vibrations occur during handling. When the magnet carrier plate 4 with the workpieces 2 has reached the position shown in FIG. 1, the rocker 8 is moved under the magnet carrier plate 4 and the workpieces 2 by extending the ram 9. Since the rollers 10 run on the rail 11, this extension of the ram will cause the rocker to move into the oblique position illustrated in FIG. 1 where the lower end of the rocker is located directly above the chute 3. Alternatively, movement of the rocker 8 into the oblique position may be controlled in such a manner that the rocker 8 will first be positioned horizontally, or almost horizontally, at a close distance under the workpieces 2 of the magnet carrier plate 4 and only swiveled into the oblique position shown, by means of a tipping or hoisting device (not shown), for example, after the workpieces 2 have been dropped onto the rocker 8.

In order to cause the magnet carrier plate 4 to release the workpieces 2, the excitation of the electromagnets, i.e. the holding magnets 12, is reduced. When the holding force is no longer sufficient, the workpieces drop onto the rocker 8. If the rocker 8 is located directly under the workpieces 2, demagnetization of the workpieces 2 can be achieved by subsequent further reduction of excitation. If the rocker 8 is located under the workpieces 2 at a major distance, the same procedure can be followed as before or else the excitation can be increased, after the workpieces 2 have started to drop, to a point not sufficient to re-attract the workpieces, but enough to assure a sufficient initial amplitude of the alternating magnet field in the region of the dropping workpieces to effect demagnetization when the workpiece then moves away from the magnet carrier plate 4 so that the strength of the alternating field decreases. Alternatively, excitation can be turned off for one or more cycles of the a.c. supply by means of the apparatus 20 or 23 so that the workpieces start to drop. When excitation is then turned on again after one or more cycles, it can be set either to a lower, the same or a higher value, but in any case so that the workpieces will not be re-attracted, but will nevertheless be demagnetized sufficiently by the alternating field of decreasing strength. Turning off the excitation can be effected by means of conventional electronic or digital switching elements in a manner known per se so that these elements need not be described here in detail.

The downward movement and, more particularly, the final portion of the downward movement of the magnet carrier plate 4 may be controlled, in a manner known per se, by means of switches which are actuated by one of the movably retained holding magnets 12. This solution has also been adopted for the prior art device described herein first above. The upward movement may be terminated by means of limit switches, i.e. mechanical microswitches (not shown) inductive proximity-type switches or light barriers. The ram 9 may also be controlled in the same manner. Alternatively, the downward movement may be terminated by sensing the inductance variation of a winding 17 upon approach of a workpiece 2 and utilizing this variation to terminate the downward movement. Such use of inductance variation as control signal for the conveyance of a workpiece is described in German "Offenlegungsschrift" * No. 25 54 046.

*Offenlegungsschrift = printed publication of the unexamined application

It shall be understood that the present invention is not limited to the diagrammatically represented embodiments shown by way of example and that deviations therefrom are possible within the scope of this invention. In particular, it shall be understood that the individual features of this invention may be employed either separately or jointly in combinations of a plurality of said features.

What is claimed is:

1. Apparatus for transferring ferro-magnetic workpieces comprising a carrier having a plurality of magnets at least one of which is a wound A-C magnet and a power supply system, comprising a source of current and means for selectively exciting said magnets to hold said workpieces thereto and for reducing the excitation of said magnets to permit said workpieces to fall therefrom, including means for the time controlled variation of the excitation of said A-C magnet during the fall of said workpieces to gradually reduce the amplitude of the magnetic field produced in the locus of said falling workpieces to thereby demagnetize said workpieces.

2. The apparatus according to claim 1, wherein said power supply system includes a three phase A-C power source, and said magnets are symmetrically connected thereto.

3. The apparatus according to claim 1, wherein said power supply system includes a regulating transformer interposed between said current source and the winding of said at least one A-C magnet, said regulating transformer having means for varying the ratio of its output to control the excitation of said A-C magnet.

4. The apparatus according to claim 1, wherein said power supply system includes a phase angle control device interposed between said current source and the winding of said at least one A-C magnet and having means for successively reducing the conductive period thereof during the fall of said workpieces.

5. The apparatus according to claim 1, wherein said power supply system includes at least one switch and at least one capacitor interposed between said power source and the winding of said at least one A-C magnet, said at least one capacitor being connected in parallel with the winding of said at least one A-C magnet, whereby on disconnection of said power source by operation of said switch said capacitor can discharge into the associated winding.

6. The apparatus according to claim 1, wherein said power supply system includes switch means selectively operable to connect and disconnect said supply system for a predetermined number of cycles of the current source to said A-C magnet.

7. The apparatus according to claim 6, including means for selectively increasing the excitation of said at least one A-C magnet during period when said switch connects said A-C magnet to said current source.

8. The apparatus according to claim 1, wherein said carrer is movable and including means for selectively operating said power supply system as a function of the movement thereof.

9. The apparatus according to claim 1, wherein said A-C magnet is formed of a plurality of cores and associated windings, at least one of which is short-circuited.

* * * * *